US006979246B2

(12) United States Patent
Chu

(10) Patent No.: US 6,979,246 B2
(45) Date of Patent: Dec. 27, 2005

(54) CENTRAL SPEED CONTROL MECHANISM FOR REMOTE CONTROL CARS

(76) Inventor: Daimler Chu, PO Box 82-144, Taipei (TW)

( * ) Notice: Subject to any disclaimer, the term of this patent is extended or adjusted under 35 U.S.C. 154(b) by 0 days.

(21) Appl. No.: 10/618,606

(22) Filed: Jul. 15, 2003

(65) Prior Publication Data

US 2005/0014448 A1 Jan. 20, 2005

(51) Int. Cl.[7] ..... A63H 17/26
(52) U.S. Cl. ..... 446/448; 446/454; 446/463
(58) Field of Search ..... 446/448, 454, 446/457, 458, 461–463, 465, 466, 468, 469, 446/462; 475/231, 233, 236

(56) References Cited

U.S. PATENT DOCUMENTS 1,407,703 A * 2/1922 Moir ..... 475/249
1,756,939 A * 5/1930 Crawford ..... 475/231
3,932,956 A * 1/1976 Young ..... 446/463
4,130,963 A * 12/1978 Ohashi ..... 446/463
5,055,095 A * 10/1991 Osenbaugh et al. ..... 475/233
5,961,368 A * 10/1999 Chu ..... 446/457
6,063,000 A * 5/2000 Sugimoto ..... 475/231
6,394,927 B1 * 5/2002 Bongard ..... 475/231
6,524,211 B2 * 2/2003 Okazaki ..... 475/241

* cited by examiner

*Primary Examiner*—Bena Miller
(74) *Attorney, Agent, or Firm*—Leong C. Lei

(57) ABSTRACT

An improved central speed control mechanism for remote control cars primarily comprises a housing and a cover, which are connectable to each other and are respectively provided with a pivot for connecting to the remote control car at one end and mounting helical gears at the other end. Inside of the housing is provided with a gear set, which comprises a positioning block, a plurality of bevel gears and axles. Axle holes are equally provided on the periphery of the positioning block, whereas a central hole with a cone surface is provided in the bevel gears for matching with the cone surface of the axle which is provided with a positioning pillar at the front end and a cone surface in the middle section. After the axle passes the end of the bevel gear provided with a O-ring through to the axle hole, and a washer is further provided at the rear of the axle to complete the assembly of the whole housing, the plurality of bevel gears of the gear set will engage with the helical gears of the two pivots.

8 Claims, 6 Drawing Sheets

CENTRAL SPEED CONTROL MECHANISM FOR REMOTE CONTROL CARS

BACKGROUND OF THE INVENTION

1. Field of the Invention

The present invention relates to an improved central speed control mechanism for remote control car, which may generate an appropriate stopping force to make better speed adjustment, and is particularly applicable to remote control cars, model cars and the like.

2. Description of the Prior Art

Remote control cars are popular to children and adults as well since they are easy controlled and quite challenging for entertainment purposes. A speed controller is very important to remote control cars, no matter they are simple or complex structures. The speed controllers of the prior art (as shown in FIG. 6) primarily comprise a housing A provided with four worm gears C. Each of the worm gear C is provided with a helical gear C1 at the upper and lower end, whereas two axles B provided with worm gear B1 at the end are disposed in-between the worm gears C, such than when the axles B rotate, the worm gears C engage with helical gears C1 for transmitting force to make apparent speed difference between the two axles B and thereby prevent the wheels from slipping. However, as the engagement of the helical gears C1 appears a parallel way, it cannot generate the best twist force. Besides, in the engagement of the four worm gears C and the worm gears B1 of the two shafts B, given the numerous elements involved, there are no fix positioning points. Therefore, there exists a disadvantage of the prior art, i.e. it is difficult to dispose the assembled elements into the housing.

In view of the above, the inventor researched to provide an improved structure of the central speed controller for the remote control cars, which is composed of less elements and is easily assembled.

SUMMARY OF THE INVENTION

The primary object of the invention is to provide an improved central speed control mechanism for remote control cars, which can generate a stopping force and thereby obtain a preferred damping effect for speed adjustment.

Another object of the invention is to provide an improved central peed control mechanism for remote control cars, which is simply constructed and easily assembled.

To obtain the above purposes, the invention basically comprises a housing and a cover, which are connectable to each other and are respectively provided with a pivot for connecting to the remote control car at one end and mounting helical gears at the other end. Inside of the housing is provided with a gear set, which comprises a positioning block, a plurality of bevel gears and axles. Axle holes are equally provided on the periphery of the positioning block, whereas a central hole with a cone surface is provided in the bevel gears for matching with the cone surface of the axle, which is provided with a positioning pillar at the front end and a cone surface in the middle section. After the axle passes the end of the bevel gear provided with a O-ring through to the axle hole, and a washer is further provided at the rear of the axle to complete the assembly of the whole housing, the plurality of bevel gears of the gear set will engage with the helical gears of the two pivots. When the speed controller rotates in a high speed, the cone surfaces of the bevel gears will match with the cone surface of the axle to form a damping force, so that by the centrifugal force, the bevel gears would be drawn back to form an appropriate stopping force, thereby generating a damping force to preferably control the speed of the remote control car.

The novelty and many other advantages of the invention will become more readily appreciated as the same becomes better understood by reference to the following detailed description, when taken in conjunction with the accompanying drawings.

DETAILED DESCRIPTION OF THE PREFERRED EMBODIMENTS

Figure 1:
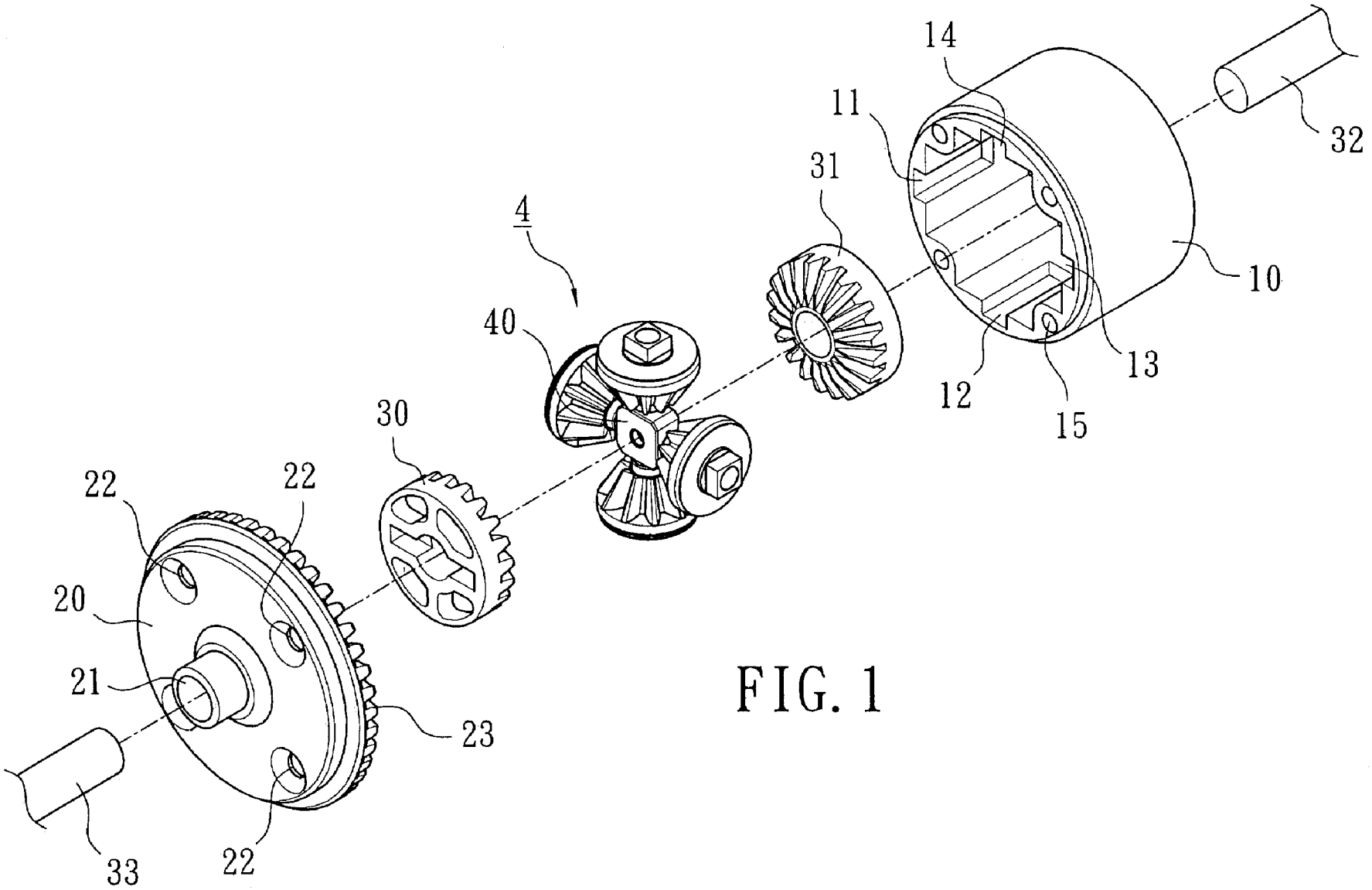
FIG. 1 is an exploded view of the speed controller according to the invention.

As shown in FIG. 1, the present invention primarily comprises a housing 10, a cover 20 and a gear set 4. Corresponding grooves 11, 13 and 12, 14 are provided on the inner wall of the housing 10. And locking holes 15 are provided in-between every two grooves. A pivot hole (not shown) is provided on the central bottom of the housing 10, such that a pivot 32 can pass through the housing 10 and connect to the wheel of the remote control car (not shown) with one end, and connect to a helical gear 31 with another end.

The cover 20 is connectable to the housing 10. A pivot hole 21 is provided on the center of the cover 20, whereas a plurality of locking holes 22 are provided on the periphery thereof. The housing 10 and the cover 20 can be assembled by way of screwing a plurality of screws (not shown) into the locking holes 22.

Inside of the pivot hole 21 is provided with a pivot 33 which is connected to the wheel (not shown) at one end and to a helical gear 30 an the other end, whereas a tooth rim 23 is provided on the rim of the cover 20.

Figure 2:
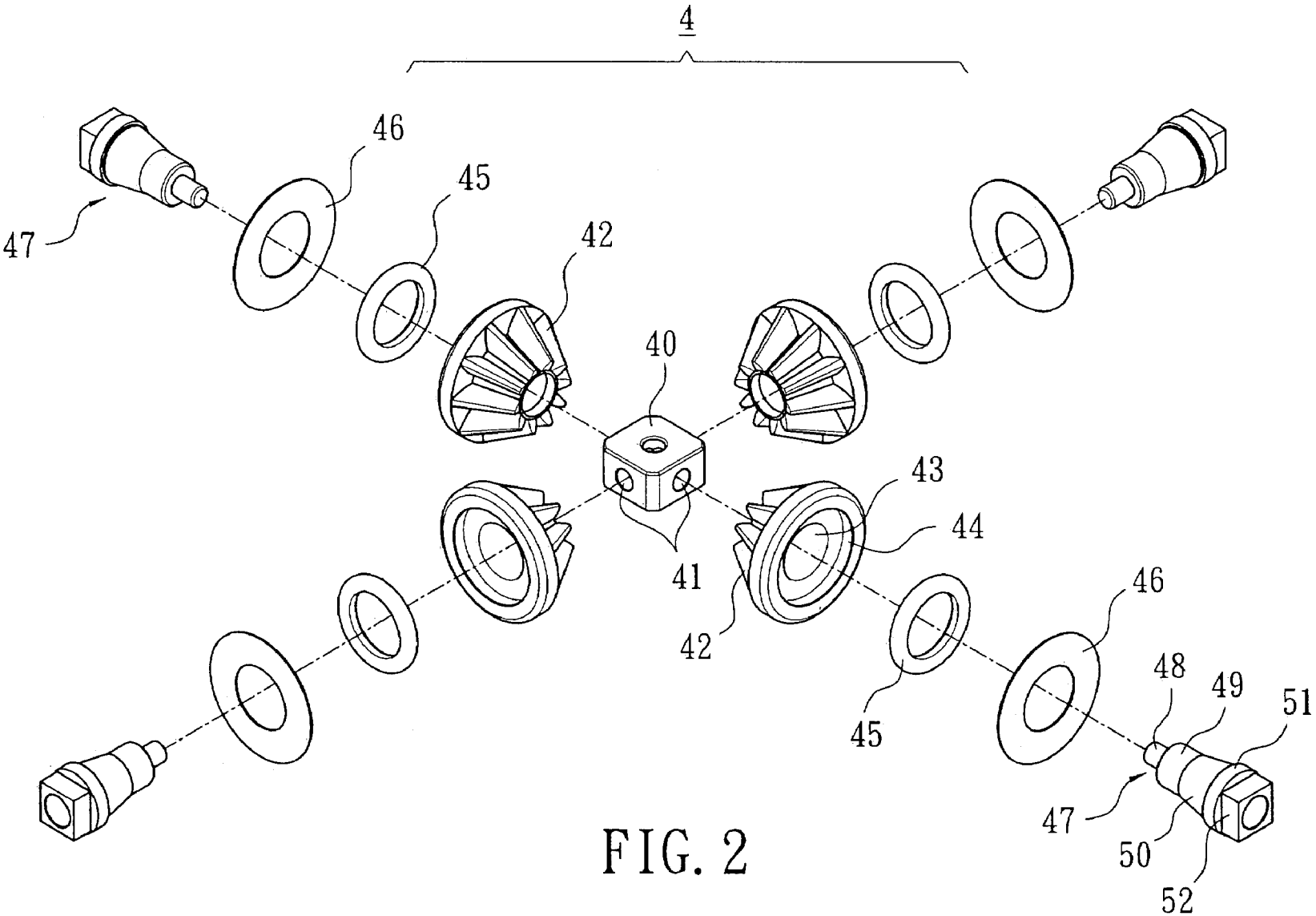
FIG. 2 is an exploded view of the gear set of the invention.
Figure 3:
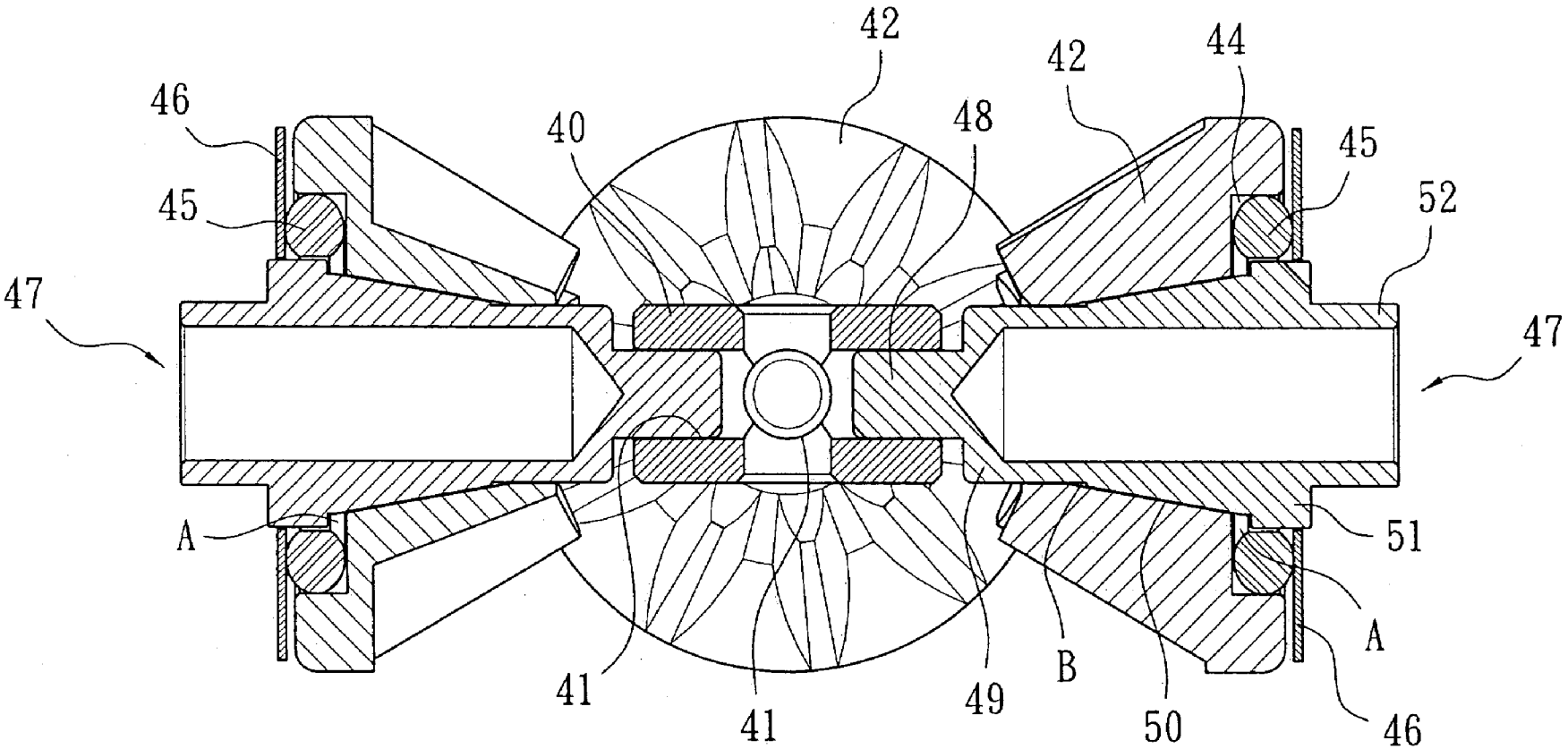
FIG. 3 is a cross-sectional view of the gear set after being assembled.

Referring to FIGS. 2 and 3, the gear set 4, which includes a positioning block 40, a plurality of bevel gears 42 and axles 47. A positioning hole 41 is provided on the respective peripheral faces of the positioning block 40. In the center of the bevel gear 42 is a central hole 43 at the end of which is provided with outwardly expanded stairs 44, so that an O-ring 45 can be received therein, as well as a washer 46 be additionally provided.

Figure 4:
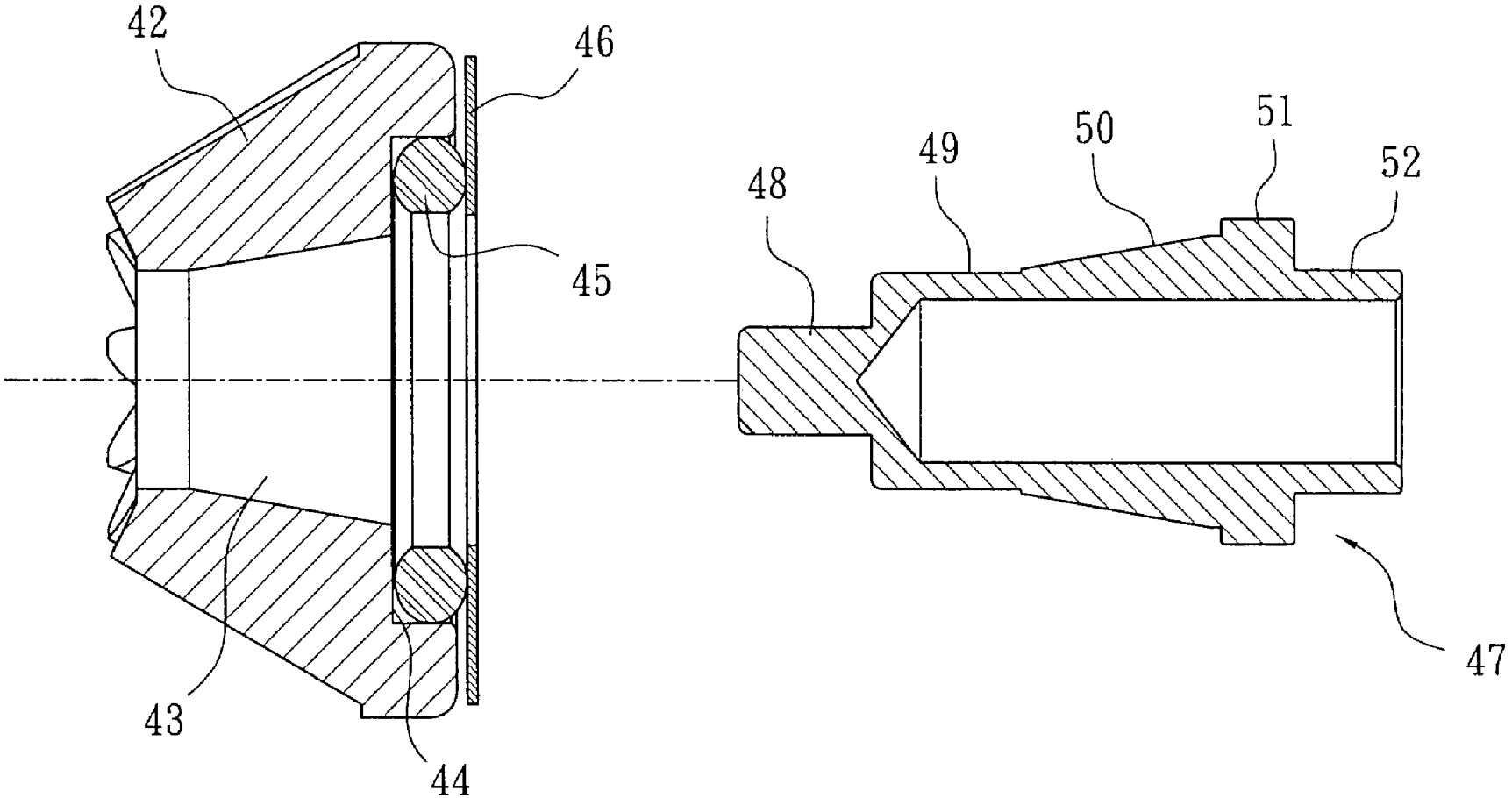
FIG. 4 is a partially cross-sectional view of the gear set.

Referring to FIG. 4, a positioning pillar 48 is provided at the front end of the axle 47 which forms a cone surface 50 by degree towards the middle portion. The front end of the cone is provided with a shaft section 49 of the same diameter, whereas the rear end of the cone is provided with a shaft section 51 of larger diameter. The end of the axle 47 is provided with a square cap 52.

Referring to FIGS. 3 and 4, when assembling the gear set 4, the O-ring 45 will be disposed in the stairs 44 at the end of the bevel gear 42 first, and the washer 46 is disposed in addition to the O-ring 45, and then have the axle 47 pass through the washer 46, O-ring 45 and the bevel gear 42 with the cone surface 50 of the axle 47 stay in the central hole 43 of the bevel gear 42. By way of the engagement of the positioning pillar 48 of the axle 47 with axle hole 41 on the periphery of the positioning block 40, the assembly of the gear set 4 is completed.

Figure 5:
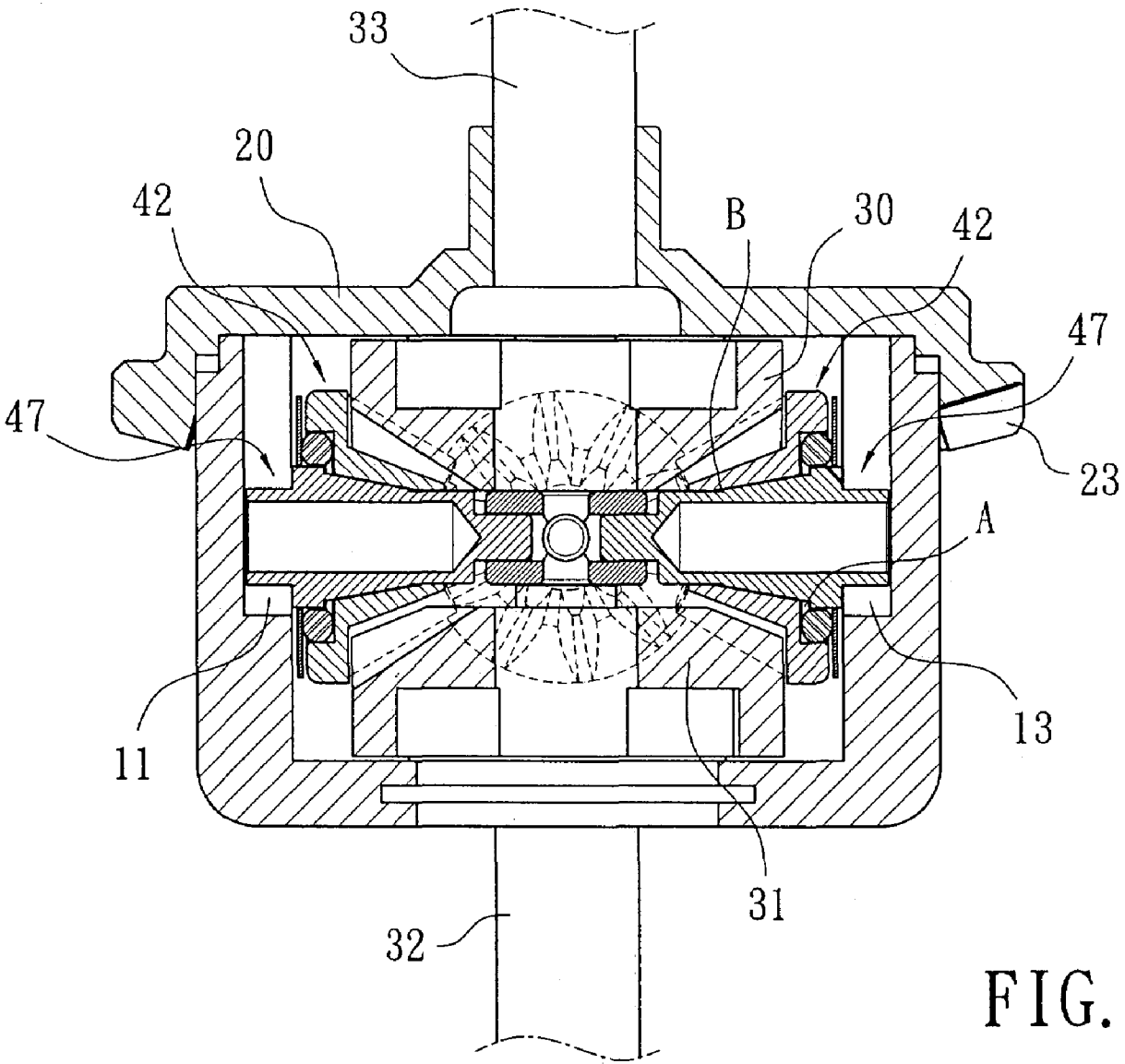
FIG. 5 is a cross-sectional view of the speed controller after being assembled.
Figure 6:
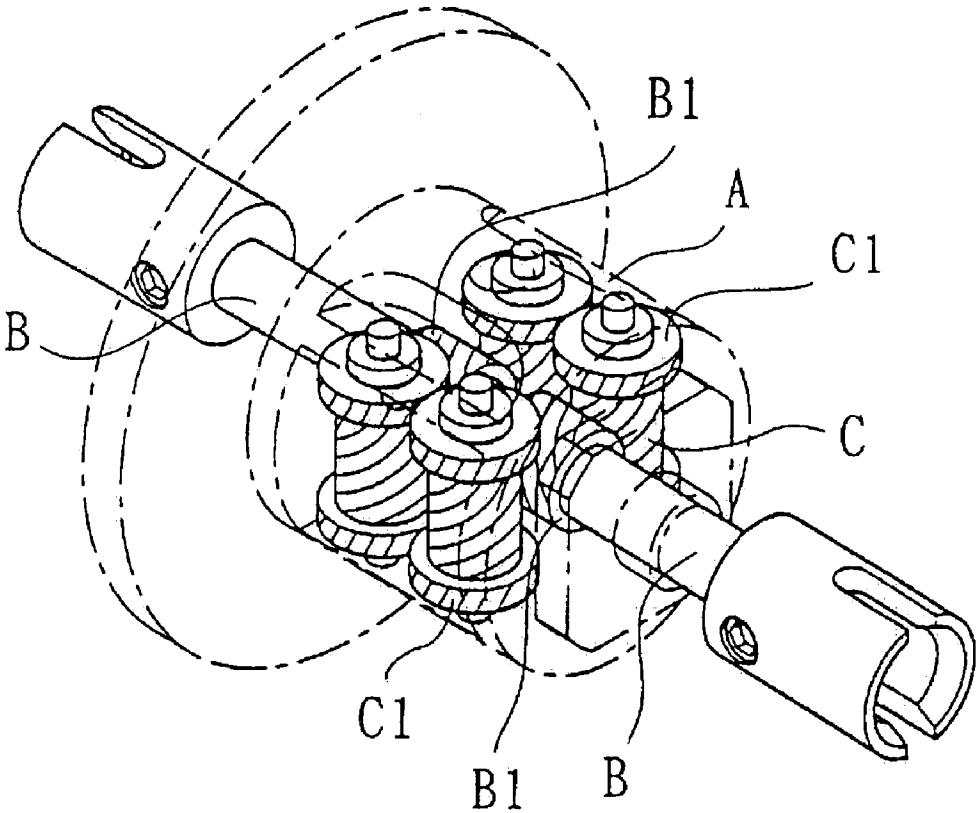
PRIOR ART Fig. 6
FIG. 6 is a perspective view of the speed controller or the prior art.

Now concomitantly refer to FIGS. 1 and 5, the assembled gear set 4 is inserted into the housing 10 with the square cap 52 at each end of the axle 47 aimed at the grooves 11, 12, 13, 14 on the inner wall of the housing 10. As the width of the square caps 52 match with that of the grooves 11, 12, 13, 14, the axles 47 can be positioned without rotating. In the case of round caps of the axles 47, whatever can be positioned inside of the grooves (11–14) on the inner wall of the housing 10 can be used to obtain the same function.

After inserting the gear set 4 into the housing 10, the bottom of the gear set 4 is engaged with the helical gears 31 at one end of the pivot 32. Due to the cover's 20 being received by the opening of the housing 10, the helical gears 31 at one end of the pivot 32 can engage with the top of the four gear sets 4, thereby completing the assembly of the speed controller according to the invention.

When the remote control car is actuated, the power of the motor will be transmitted to the wheels through the tooth rim 23 around the speed controller, so that the remote control car can move in a liner direction. When making a turn, the gear set 4 will engage with the helical gears 30, and the helical gears 31 will engage with each other. The match of the cone surface specially designed for the axles 47 and the bevel gears 42, as well as the shaft sections 49 and 51 provided at the front and rear ends of the cone of the axle 47, can prevent the engaging cone surface 50 of the axle 47 and the cone surface of the central hole 43 from getting stuck.

When the gear set 4 of the speed controller rotates, each bevel gear 42 would be drawn back (toward the side away from the positioning block 40) to form a cone-engagement stopping force along the axis direction of the axle, thereby generating a damping force in-between the cone surface 50 and the central hole 43 due to the centrifugal force generated by the weight of the elements of the bevel gear 42. However, said cone-engagement stopping force need controlled to prevent the cone surfaces 50 and 43 from getting stuck and ceasing operation. Therefore, a small space A is formed in-between the axle 47 to be connected to the cone surface of the central hole 43 and the vertical wall of the shaft section 51; and a space B is formed in-between the shaft section 49 and central hole 43. When the bevel gear 42 is drawn back, it will press on the O-ring 45, which subsequently generates a resistant force, as well as a friction damping force. By way of the match of the bearing outside of the speed controller, the two pivots 32, 33 at two ends can obtain an excellent regulation in speed, thereby the remote control car can turn smoothly and easily.

In view of the above, the structure according to the invention has the following advantages:

1. Given the simple components, the gear sets can he easily inserted into the housing after being assembled, without spreading out due to movement.
2. The cone-engagement of each bevel gear and axle can generate a certain data of engagement damping force, rendering the speed difference generated by the speed controller more apparent.
3. Due to the provision of the O-ring, when the bevel gear presses thereon, the O-ring will generate an appropriate resistant force and friction damping force to make better speed difference.

Concluded above, it is novel to the design of a speed control mechanism for the present remote control cars, and the efficiency is highly improved. Accordingly, the inventor has claimed his invention.

Although specific embodiments have been illustrated and described, it will be obvious to those skilled in the art that various modifications may be made without departing from what is intended to be limited solely by the appended claims

I claim:

1. A central speed control mechanism for remote control cars comprising:

a housing and a cover connectable to the housing, the housing having an inner wall provided with grooves, a tooth rim provided on a rim of the cover, two pivots each provided with a helical gear at an end and passing through both of the housing and the cover; and a gear set including a positioning block, a plurality of bevel gears and axles, axle holes being equally provided on a periphery of the positioning block for the axles to engage and position therein, a central hole with a cone surface being provided in the bevel gears, a front end of the axles being provided with a positioning pillar which forms a cone surface by degree, a rear end of the axles being in the form of the same shape as each of the grooves on the inner wall of the housing for engagement purposes, expanding stairs being provided in the central hole of the bevel gears of the gear set for receiving an O-ring therein, such that when the bevel gears are drawn back due to centrifugal force, the O-ring will be pressed to generate a restoring force;

whereby when the axles are inserted into the central hole of the bevel gears, the axles are assembled to the periphery of the positioning block; and after assembling the gear set into the housing and connecting the cover with the housing as a whole, the helical gear at the end of the pivots will engage with the bevel gears; when the speed control mechanism rotates, the cone surface of the central hole of the bevel gears will match with the cone surface of the axles; and under centrifugal force generated by the bevel gears of the gear set, the bevel gears would be drawn back to form a cone-engagement stopping force along an axis direction of the axles, thereby generating a damping force.

2. The central speed control mechanism for remote control cars according to claim 1, wherein shaft sections of equal diameter are provided in a front of the cone surface of the axles to prevent engaging cone surfaces from getting stuck.

3. The central speed control mechanism for remote control cars according to claim 1, wherein shaft sections of equal diameter are provided in a rear of the cone surface of the axles to prevent engaging cone surfaces from getting stuck.

4. The central speed control mechanism for remote control cars according to claim 1, wherein shaft sections of equal diameter are provided in a front of the cone surface of the axles thereby forming a space in-between the cone surface of the central hole of the bevel gears and the cone surface of the axles when connecting with each other, and therefore preventing engaging cone surfaces from getting stuck.

5. The central speed control mechanism for remote control cars according to claim 1, wherein shaft sections of equal diameter are provided in a rear of the cone surface of the axles thereby forming a space in-between the cone surface of the central hole of the bevel gears and the cone surface of the axles, and therefore preventing engaging cone surfaces from getting stuck.

6. The central speed control mechanism for remote control cars according to claim 1, wherein the gear set is composed of a positioning block, four bevel gears, and four axles.

7. The central speed control mechanism for remote control cars according to claim 1, wherein the inner wall of the housing is provided with four grooves.

8. The central speed control mechanism for remote control cars according to claim 1, wherein an inner end of the axles is in form of a square cap, such that when the inner end is engaged with a respective one of the grooves in the inner wall of the housing, the speed control mechanism will stop rotating.

* * * * *